US008016305B2

(12) United States Patent
Cheng

(10) Patent No.: US 8,016,305 B2
(45) Date of Patent: Sep. 13, 2011

(54) HEIGHT ADJUSTMENT MECHANISM FOR BABY WALKER

(75) Inventor: Chung-Jen Cheng, Tainan (TW)

(73) Assignee: Jin Sun Gee Plastics Co., Ltd., Tainan (TW)

( * ) Notice: Subject to any disclaimer, the term of this patent is extended or adjusted under 35 U.S.C. 154(b) by 294 days.

(21) Appl. No.: 12/457,012

(22) Filed: May 29, 2009

(65) Prior Publication Data

US 2010/0301586 A1 Dec. 2, 2010

(51) Int. Cl.
*B62B 7/00* (2006.01)

(52) U.S. Cl. ..... 280/87.051

(58) Field of Classification Search ..... 280/87.01, 280/87.03, 87.05, 87.051, 638, 639, 647, 280/648, 649, 650, 657; 297/149, 150; 108/115, 108/116, 117, 118, 119, 120, 144.11, 145, 108/146, 147.22

See application file for complete search history.

(56) References Cited

U.S. PATENT DOCUMENTS 4,019,756 A * 4/1977 Ishida ..... 280/649
4,065,086 A * 12/1977 Nakao ..... 248/188.6
4,359,242 A * 11/1982 Gerken et al. ..... 297/5
4,364,576 A * 12/1982 Kassai ..... 280/87.051
4,433,869 A * 2/1984 Payne et al. ..... 297/5
4,576,392 A * 3/1986 Quinlan, Jr. ..... 280/87.051
4,615,523 A * 10/1986 Chen ..... 280/87.05
4,632,595 A * 12/1986 Schaeff ..... 403/330
4,723,813 A * 2/1988 Kassai ..... 297/153
4,759,541 A * 7/1988 Chen ..... 482/68
4,799,700 A * 1/1989 Knoedler et al. ..... 280/87.051
4,884,799 A * 12/1989 Chai ..... 482/66
5,031,899 A * 7/1991 Chiu ..... 482/68
5,050,504 A * 9/1991 Mulcaster ..... 104/242
5,131,719 A * 7/1992 Kassai ..... 297/344.18
5,324,064 A * 6/1994 Sumser et al. ..... 280/649
5,351,978 A * 10/1994 Chen ..... 280/87.051
5,447,319 A * 9/1995 Huang ..... 280/87.051
5,462,300 A * 10/1995 Chien ..... 280/87.051
5,564,724 A * 10/1996 Huang ..... 280/87.051
5,727,800 A * 3/1998 Liu ..... 280/87.051
5,813,681 A * 9/1998 Saint et al. ..... 280/87.051
5,813,720 A * 9/1998 Huang ..... 297/5
5,820,527 A * 10/1998 Lai ..... 482/68
5,865,460 A * 2/1999 Huang ..... 280/642
5,938,218 A * 8/1999 Chuang ..... 280/87.051
6,224,077 B1 * 5/2001 Sheng ..... 280/87.051
6,244,606 B1 * 6/2001 Yang ..... 280/87.051
6,306,066 B1 * 10/2001 Yang ..... 482/68
6,692,070 B1 * 2/2004 Hou et al. ..... 297/153
7,021,650 B2 * 4/2006 Chen ..... 280/642
2004/0119258 A1 * 6/2004 Yoo ..... 280/87.051
2004/0239061 A1 * 12/2004 Chen ..... 280/47.35
2005/0082779 A1 * 4/2005 Cheng ..... 280/87.051
2010/0293713 A1 * 11/2010 Sharps et al. ..... 5/86.1

* cited by examiner

*Primary Examiner* — J. Allen Shriver, II
*Assistant Examiner* — Brodie Follman
(74) *Attorney, Agent, or Firm* — Rosenberg, Klein & Lee

(57) ABSTRACT

A height adjustment mechanism for baby walkers includes a locating member disposed on the bottom of a top plate of a main body, a first side bar and a second side bar crossed pivoted with each other, and a movable control member arranged at the bottom end of the locating member and also connected with the first side bar. The locating member and a connection plate are respectively disposed with a locking part and at least one adjustment member, corresponding to each other. The control member is pivoted with a protection cover and a control button is disposed on the front side of the control member while a stopping part is arranged projectingly at the front end of the control button for stopping the protection cover and fixing the control member.

7 Claims, 7 Drawing Sheets

HEIGHT ADJUSTMENT MECHANISM FOR BABY WALKER

BACKGROUND OF THE INVENTION

1. Fields of the Invention

The present invention relates to a height adjustment mechanism for baby walkers, especially to a height adjustment mechanism that is convenient to adjust the height of a body of the baby walker with high safety.

2. Descriptions of Related Art

Nowadays Taiwan has encountered the problems of population and procreation. Once low fertility continues, we will face various economic and social crises such as aging of population, workforce gap, social imbalance and stalling economy. All these problems are resulted from decline of birth rate. To be a single child in a family, the child has privileges as well as protection. Parents always give all the best things they can afford to their children and take good care of the children. For example, most of the families will buy a baby walker for convenience of feeding and nursing. There is no need to worry about the children getting dirty of their hands. At the same time, the children are kept away from dangerous things to have higher safety.

However, the baby walker mentioned above has no adjustment mechanism in use. Yet the children keep growing and the baby walker may be unable to match the height of the child

SUMMARY OF THE INVENTION

Therefore it is a primary object of the present invention to provide a baby walker in which a first side bar and a second side bar of a main body of baby walkers crossed each other move like scissors so as to adjust the height of the main body.

In order to achieve above object, a height adjustment mechanism for baby walkers of the present invention includes a main body with a top plate whose bottom surface is fastened with a locating member. A first side bar and a second side bar are crossed and pivoted with each other and both are pivoted under the bottom of the top plate. The bottom of the first side bar and the bottom of the second side bar are pivoted to a base seat whose bottom surface is disposed with a plurality of rolling wheels. A control member is arranged at the bottom end of the locating member moveably and slidingly. A connection plate connected with the first side bar is disposed on a top surface of the control member. Moreover, the locating member and the connection plate are respectively disposed with a locking part and at least one adjustment member, corresponding to each other. A sliding hole is mounted on each of two sides of the control member while an insertion pin inserts through each sliding hole to be locked above the connection plate.

It is another object of the present invention to provide a baby walker that prevents damages to the main body of baby walkers or injuries to children caused by the sudden release of the control member from the locating member so as to enhance the safety of the baby walkers.

In order to achieve above object, a baby walker of the present invention includes a protection cover that is pivoted to the control member by the insertion pin and a control button disposed on the front side of the control member. A stopping part is projectingly arranged at a front end of the control button for stopping the protection cover and fixing the insertion pin as well as the connection plate.

In an embodiment of a height adjustment mechanism for baby walkers according to the present invention, the locating member is disposed with sliding rails and the control member is arranged with sliding slots while the sliding rails and sliding slots are engaged with each other.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
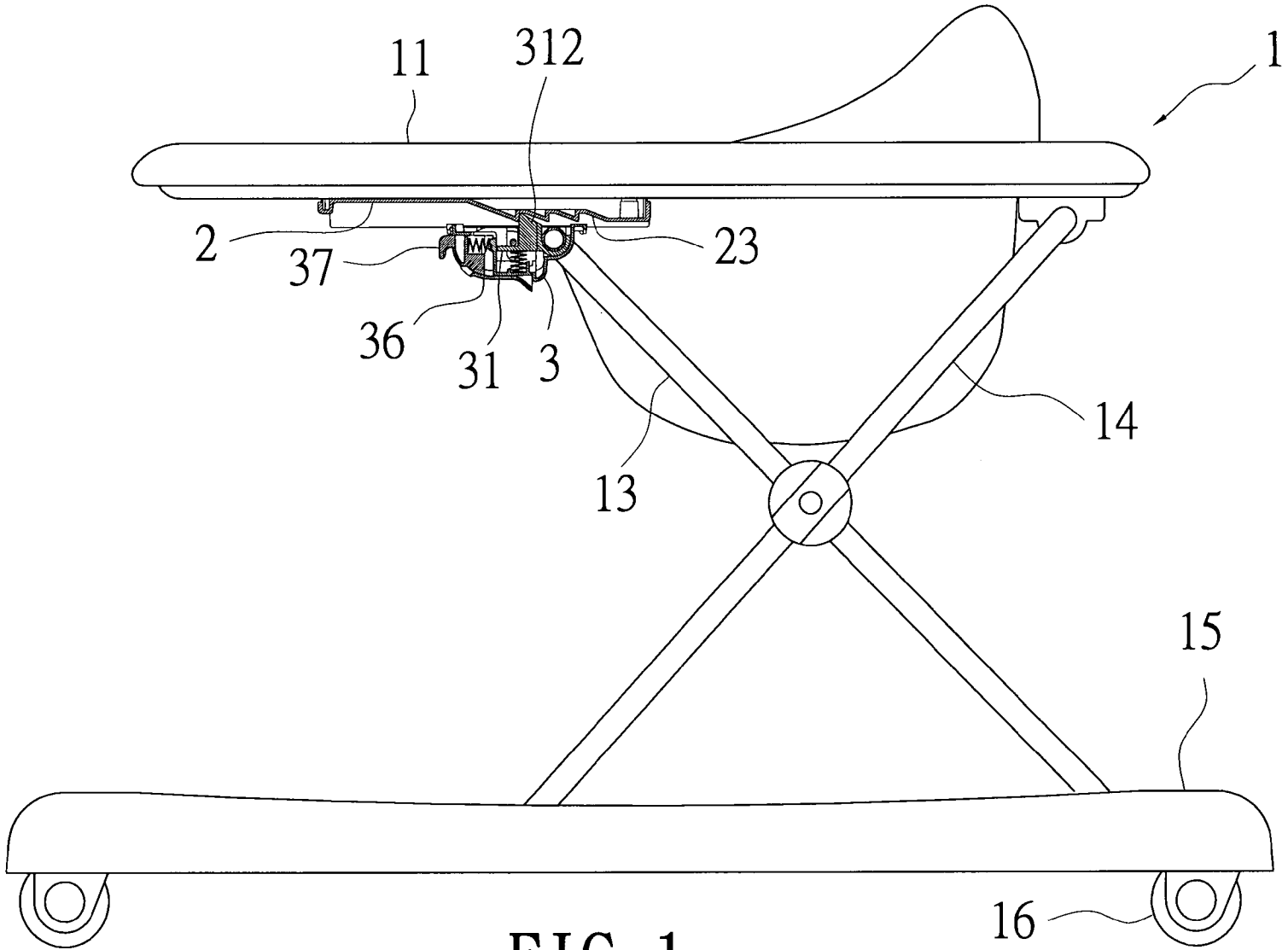
FIG. 1 shows a main body of a baby walker in an open state according to the present invention.
Figure 2:
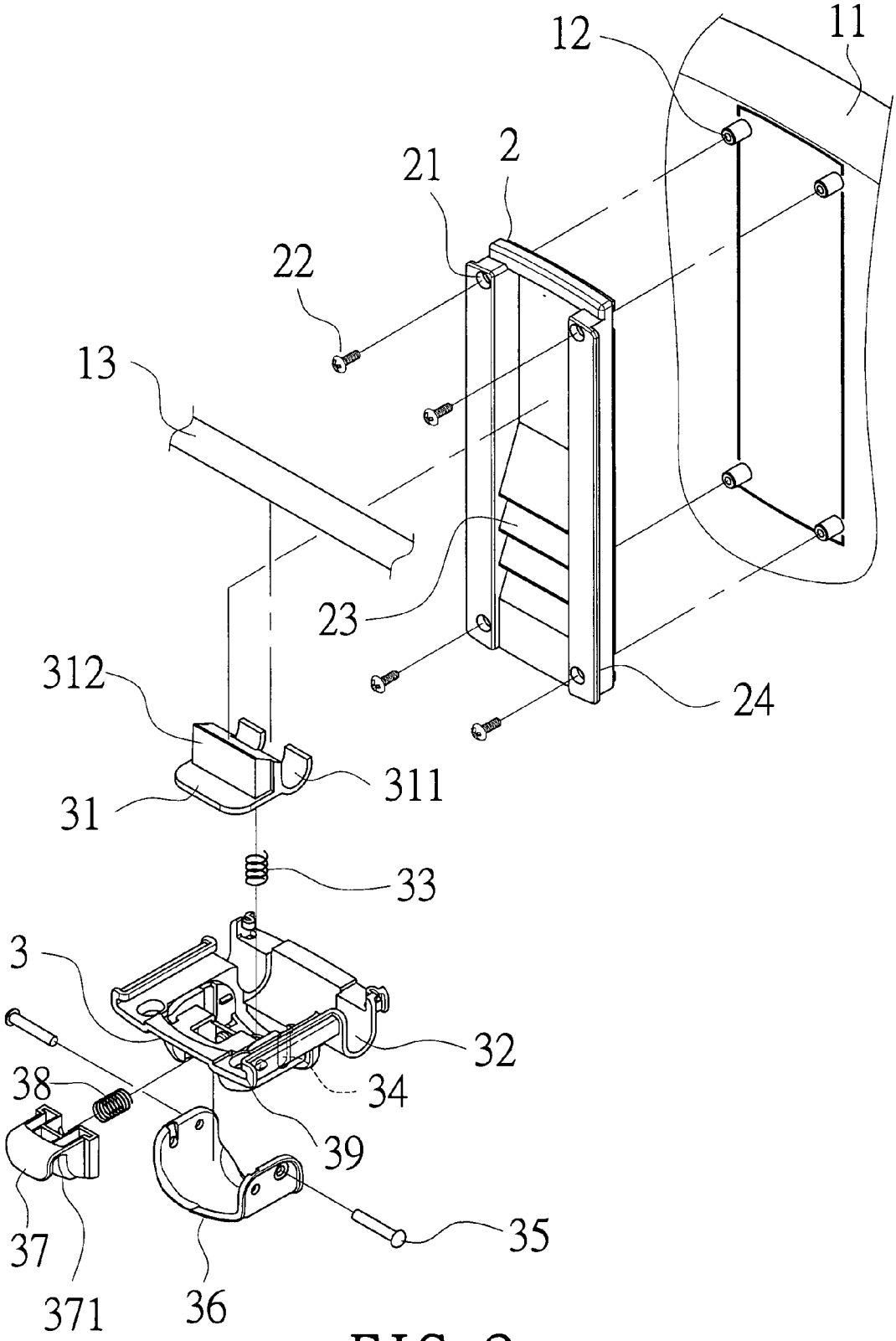
FIG. 2 is an explosive view of an embodiment according to the present invention.

Refer to FIG. 1 & FIG. 2, a height adjustment mechanism for baby walkers according to the present invention includes a main body (1), a locating member (2), and a control member (3).

A bottom of a top plate (11) of the main body (1) is disposed with a plurality of screw holes (12), corresponding to each insertion holes (21) surrounding the locating member (2) so as to fasten and fix the locating member (2). A first side bar (13) is pivoted on the bottom of the top plate (11) and a second side bar (14) is crossed and pivoted on the middle of the first side bar (13). The bottom of the first side bar (13) and the bottom of the second side bar (14) are pivoted to a base seat (15) whose bottom surface is disposed with a plurality of rolling wheels (16) for convenient movement of the main body (1).

The circumference of the locating member (2) is disposed with a plurality of insertion holes (21). Each insertion hole (21) is inserted by a threaded fastener (22) so as to be fastened to the main body (1). A plurality of corresponding adjustment members (23) is arranged at the bottom of the locating member (2) so as to lock a locking part (312) of a connection plate (31). Moreover, two sides of the locating member (2) respectively are projectingly disposed with a sliding rail (24) that is received in a sliding slot (39) of the control member (3).

A connection plate (31) is disposed on a top surface of the control member (3). The rear side of the control member (3) is arranged with a long slot (32) and the rear side of the connection plate (31) is disposed with a contact part (311) corresponding to the long slot (32) so as to connect with the first side bar (13). And a locking part (312) for locking with one of the adjustment members (23) on the bottom surface of the locating member (2) is arranged projectingly at a top surface of the connection plate (31). Moreover, a first elastic member (33) is clamped between the control member (3) and the connection plate (31) so as to make the connection plate (31) have a certain elasticity. A sliding hole (34) is mounted on each of two sides of the control member (3) while an insertion pin (35) that is locked above the connection plate (31) inserts through each sliding hole (34). Furthermore, a protection cover (36) is pivoted by means of the insertion pin (35) to the bottom surface of the control member (3). A control button (37) is disposed on the front side of the control member (3). A second elastic member (38) is clamped between the control button (37) and the control member (3) so as to provide the control button (37) a certain elastic force. A stopping part (371) is disposed projectingly on a front end of the control button (37) for stopping the protection cover (36). And a sliding slot (39) is formed on each of two sides of the top of the control member (3). The sliding rail (24) on each of two sides of the locating member (2) is received in the sliding slot (39).

While assembling, as shown from FIG. 1 to FIG. 5, each threaded fastener (22) surrounding the locating member (2) is secured in each screw hole (12) of the main body (1) so as to fix the locating member (2) on the bottom surface of the top plate (11) of the main body (1). And the first side bar (13) of the main body (1) is mounted into the long slot (32) of the control member (3) and the contact part (311) of the connection plate (31). Then each sliding slot (39) on each of two sides of the control member (3) is mounted and assembled with each sliding rail (24) on two sides of the locating member (2) so that the control member (3) slides forward and backward along with the sliding rails (24). Simultaneously, the first side bar (13) and the second side bar (14) are driven to move like scissors so as to adjust the height of the main body (1).

Figure 3:
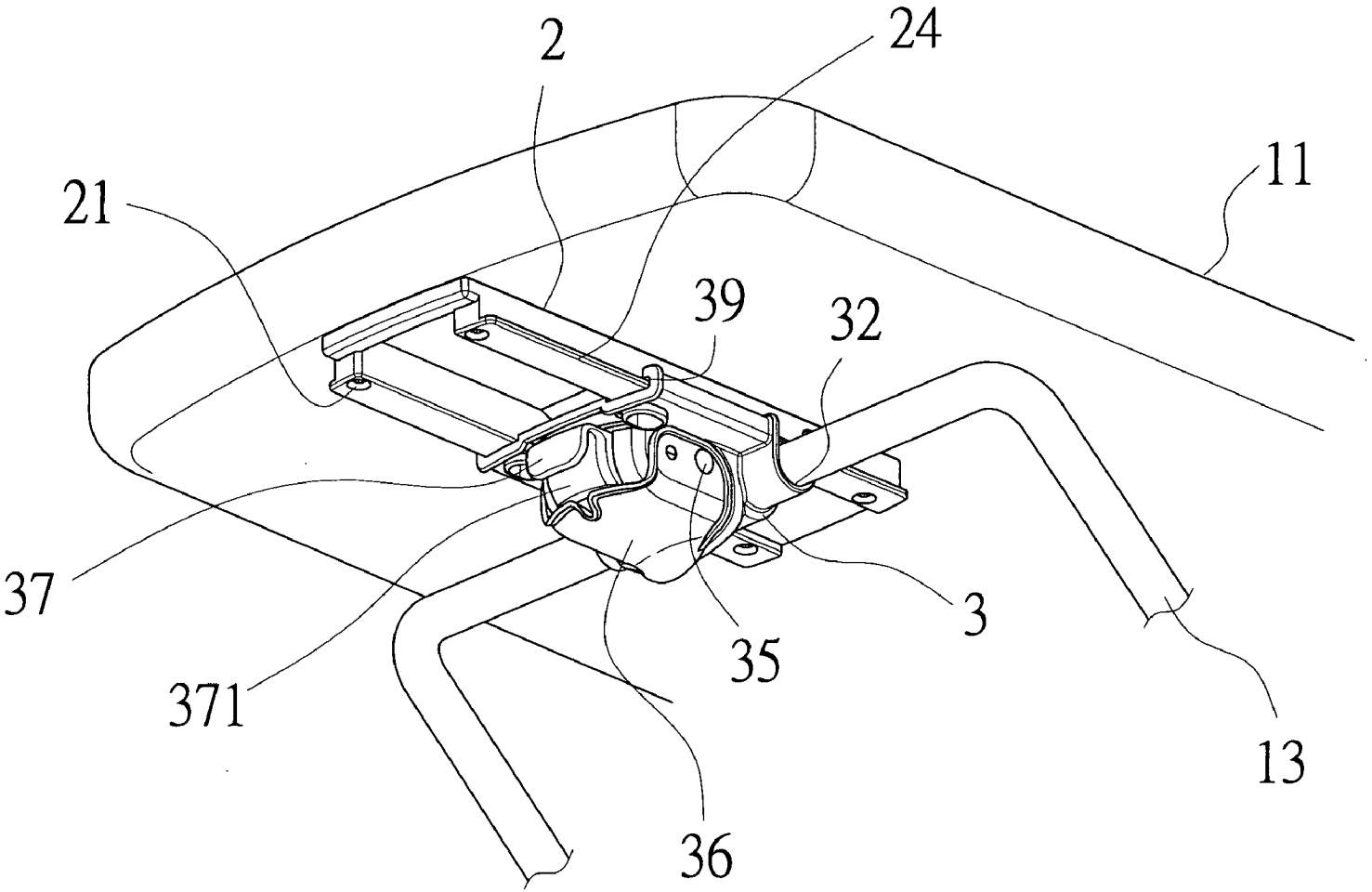
FIG. 3 is an assembly view of an embodiment according to the present invention.
Figure 4:
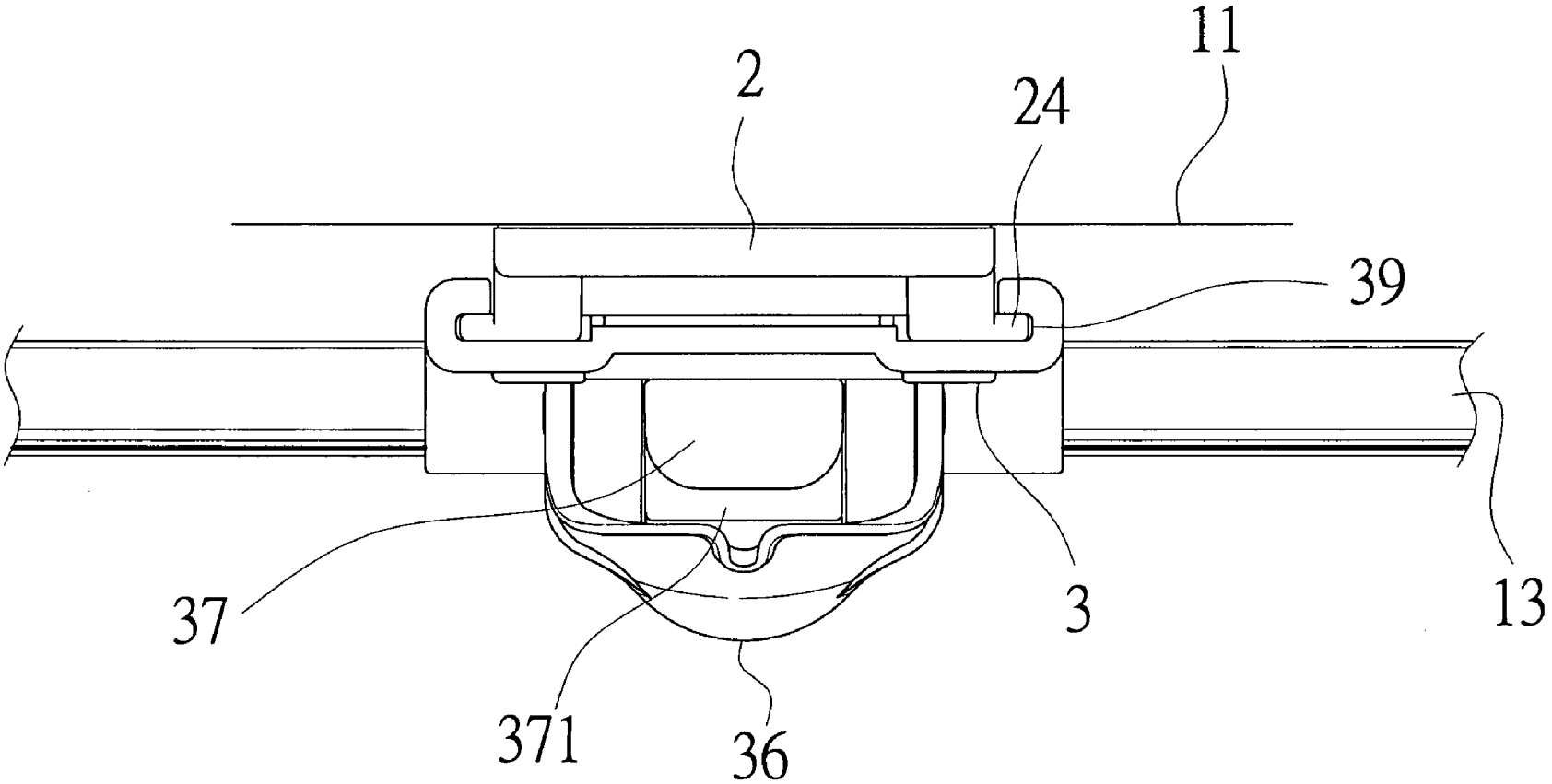
FIG. 4 a partial enlarged view of a front side of an embodiment according to the present invention.
Figure 5:
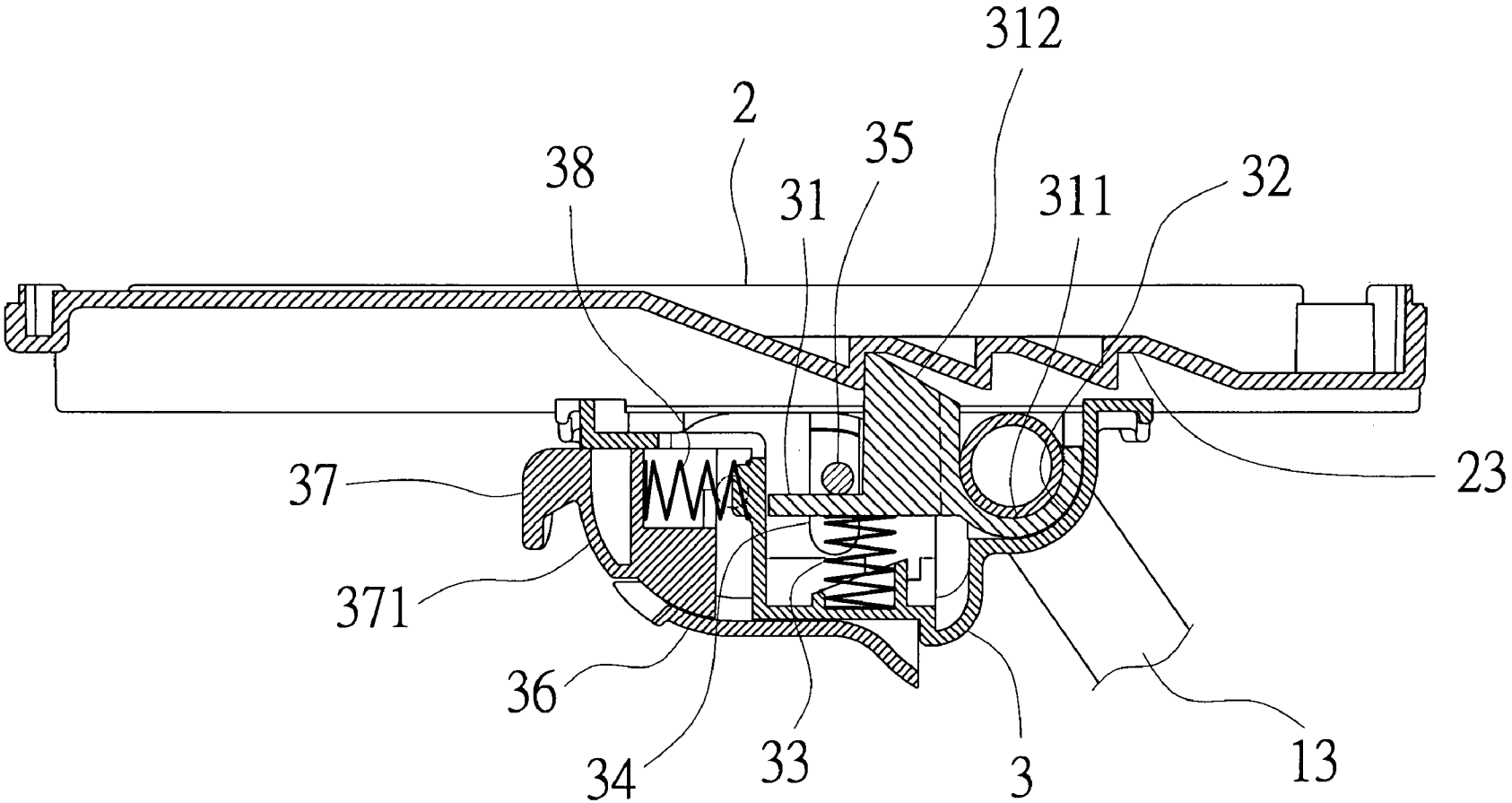
FIG. 5 shows a locating member and a control member locked with each other of an embodiment according to the present invention.
Figure 6:
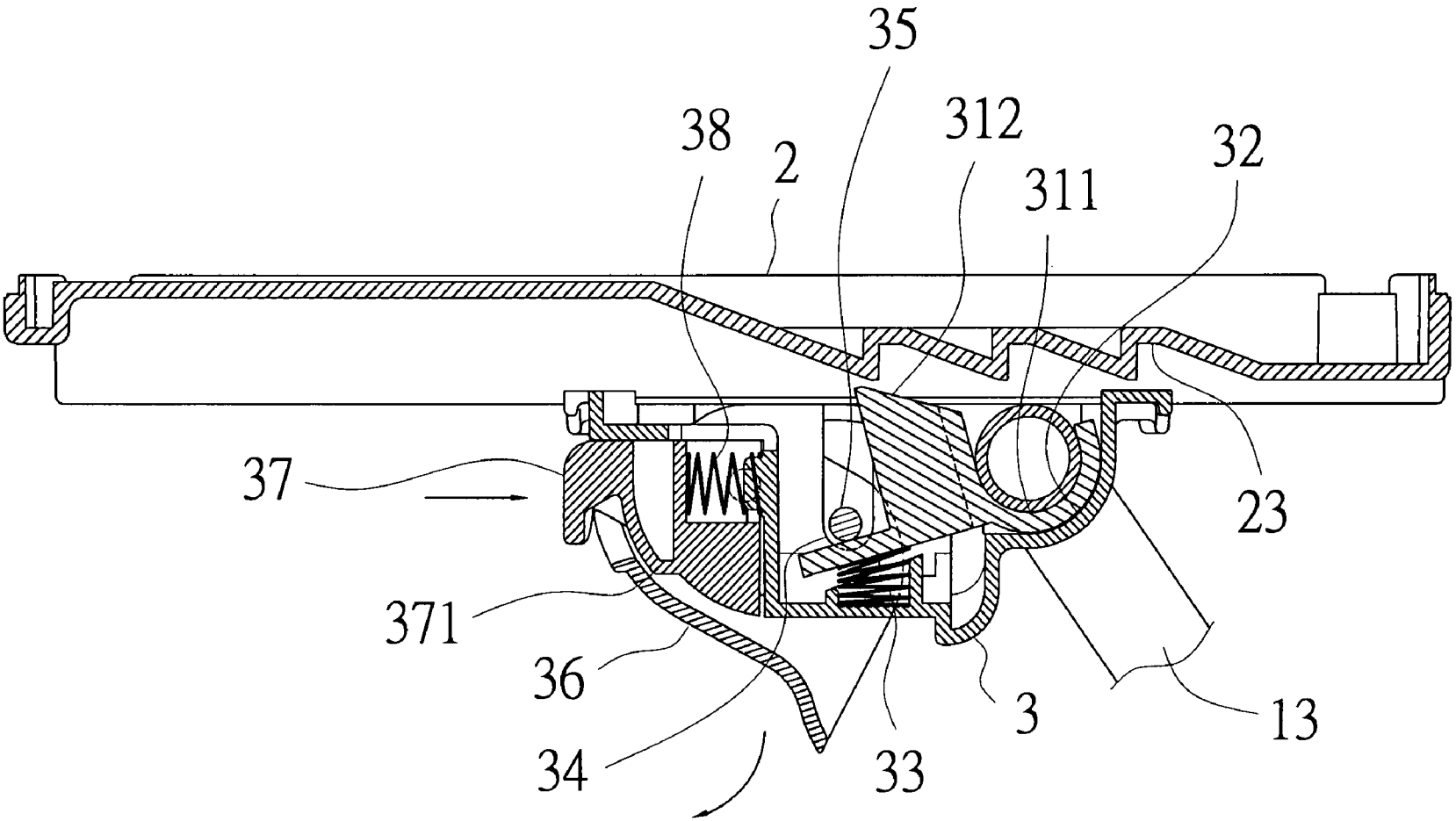
FIG. 6 shows a locating member and a control member released from each other of an embodiment according to the present invention.
Figure 7:
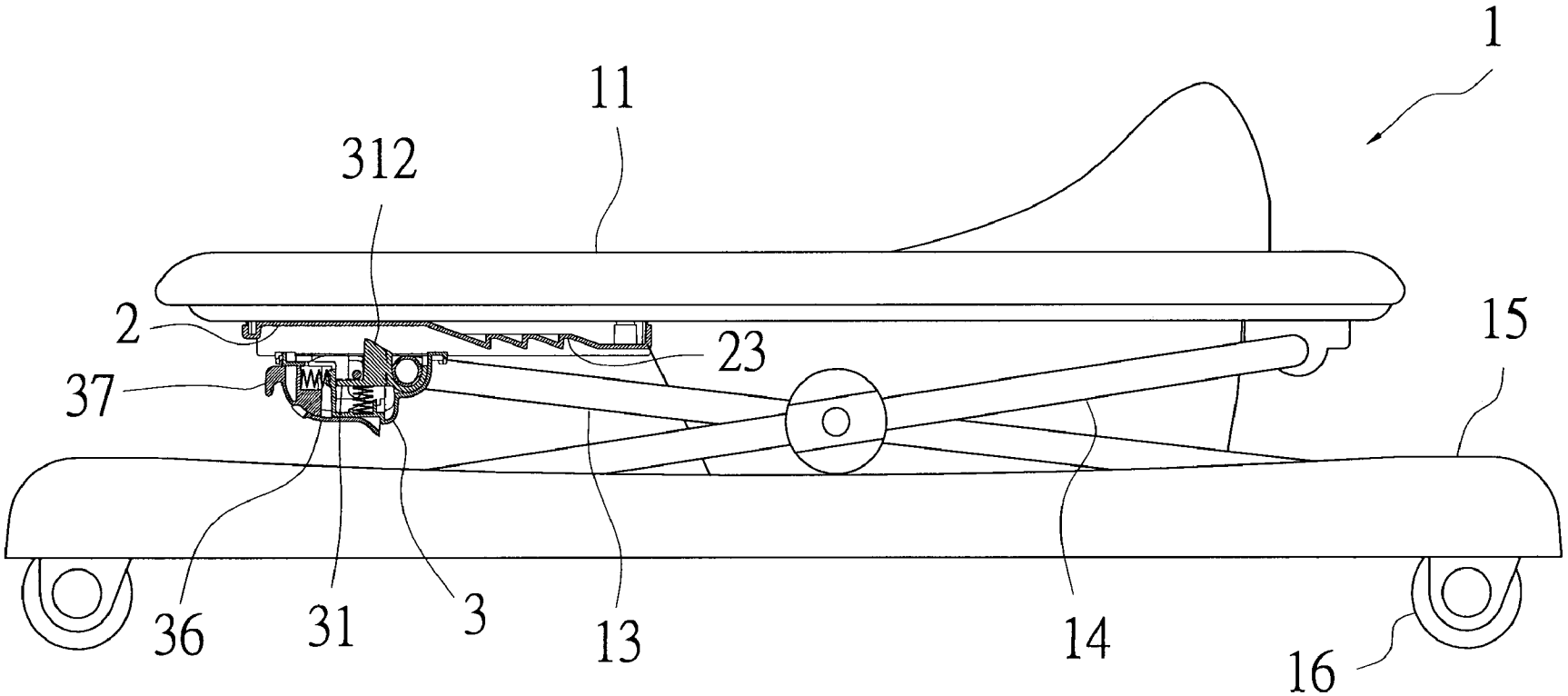
FIG. 7 shows a main body of a baby walker collapsed to fold flat according to the present invention.

In use, refer to FIG. 1, FIG. 3 & FIG. 5, firstly make the control member (3) slide backward along the sliding rails (24) of the locating member (2) so that the locking part (312) on the top surface of the connection plate (31) locks with one of the adjustment members (23) on the bottom surface of the locating member (2). The more rear the adjustment member (23) being locked by the locking part (312), the larger the height of the main body (1). Due to the protection cover (36) whose front end being stopped by the stopping part (371) of the control button (37), each insertion pin (35) is kept on a center of the sliding hole (34). Thus the locking part (312) will not be released from the adjustment member (23) suddenly that results in damages to the main body (1) or injuries to children. Once the height of the main body (1) needs to be adjusted, refer to FIG. 6, the control button (37) on the front side of the control member (3) is pressed and the protection cover (36) is pulled forward so as to driven the insertion pin (35) sliding downward to the bottom of the sliding hole (34). Thus the connection plate (31) moves downward and the locking part (312) is released from the adjustment member (23). Then the control member (3) is moved slidingly so that the locking part (312) is locked into another adjustment member (23). Or the control member (3) can also slide to the front end of the locating member (2), as shown in FIG. 7, the first side bar (13) and the second side bar (14) look like scissors in an open state while the distance between the first side bar (13) and the second side bar (14) on the bottom of the main body (1) is maximum. Thus the height of the main body (1) is minimized and the volume of the baby walker is reduced. The main body (1) is collapsed for transportation or storage.

Compared with the baby walkers available now, baby walker of the present invention has the following advantages:

1. A locating member is fastened on the bottom surface of the top plate of the main body and a first side bar on the bottom of the main body is connected with a control member that is locked with the locating member slidably and movably. Thus the first side bar and a second side bar of the main body are operated to be opened or closed, moving like scissors. Therefore, the height of the main body of baby walkers is adjusted.

2. The control member of the present invention is disposed with a protection cover and a control button locked with each other so that the control member is kept locked on the locating member. Thus damages to the main body of baby walkers or injuries to children caused by sudden releasing of the control member from the locating member can be avoided. Therefore, the safety of the device is substantially enhanced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A height adjustment mechanism for baby walkers comprising:

a main body;

a locating member fixed on a bottom of a top plate of the main body;

a second side bar pivoted on the bottom of the top plate;

a first side bar crossed pivoted with the second side bar;

a slidable and movable control member arranged at a bottom end of the locating member;

a connection plate disposed on a top surface of the control member and connected with a top end of the first side bar;

a locking part and at least one corresponding adjustment member on the connection plate and the locating member;

a sliding hole mounted on each of two sides of the control member while an insertion pin inserts through each sliding hole to be locked above the connection plate;

a protection cover pivoted by the insertion pin and a control button disposed on a front side of the control member, and a stopping part projectingly arranged at a front end of the control button corresponding to the protection cover.

2. The device as claimed in claim 1, wherein the top plate is disposed with at least one screw hole and the locating member is arranged with at least one insertion hole while a threaded fastener inserts through the insertion hole to be fastened to the screw hole.

3. The device as claimed in claim 1, wherein locating member is disposed with at least one sliding rail and the control member is arranged with at least one sliding slot while the sliding rail and sliding slot are engaged with each other.

4. The device as claimed in claim 1, wherein the control member and the connection plate are respectively disposed with a long slot and a contact part corresponding to the long slot while the first side bar is mounted into the long slot and the contact part.

5. The device as claimed in claim 1, wherein an elastic member is clamped between the control member and the connection plate.

6. The device as claimed in claim 1, wherein an elastic member is clamped between the control button and the control member.

7. The device as claimed in claim 1, wherein a bottom of the first side bar and a bottom of the second side bar are pivoted to a base seat whose bottom surface is disposed with a plurality of rolling wheels.

* * * * *